US007032774B2

(12) United States Patent
Boehm et al.

(10) Patent No.: US 7,032,774 B2
(45) Date of Patent: Apr. 25, 2006

(54) WEB BURSTER/INSERTER

(75) Inventors: Michael G. Boehm, De Pere, WI (US); Rob W. Lindquist, De Pere, WI (US)

(73) Assignee: Northfield Corporation, De Pere, WI (US)

( * ) Notice: Subject to any disclaimer, the term of this patent is extended or adjusted under 35 U.S.C. 154(b) by 294 days.

(21) Appl. No.: 10/718,040

(22) Filed: Nov. 19, 2003

(65) Prior Publication Data

US 2004/0149767 A1 Aug. 5, 2004

Related U.S. Application Data

(63) Continuation-in-part of application No. 09/680,892, filed on Oct. 6, 2000, now abandoned.

(51) Int. Cl.
*G07F 11/66* (2006.01)

(52) U.S. Cl. ..... 221/25; 225/100

(58) Field of Classification Search ..... 221/25, 221/26, 30, 31, 71, 70, 253, 260; 225/100, 225/4, 93

See application file for complete search history.

(56) References Cited

U.S. PATENT DOCUMENTS

| | | | |
|---|---|---|---|
| 2,513,093 | A | 6/1950 | Hagman |
| 2,618,336 | A | 11/1952 | Davidson |
| 2,655,842 | A | 10/1953 | Baumgartner |
| 3,127,027 | A | 3/1964 | Roser et al. |
| 3,128,928 | A | 4/1964 | Davis |
| 3,140,026 | A | 7/1964 | Davis |
| 3,146,927 | A | 9/1964 | Peterson |
| 3,182,876 | A | 5/1965 | Sedor et al. |
| 3,220,158 | A | 11/1965 | Roser et al. |
| 3,272,044 | A | 9/1966 | Obenshain |
| 3,281,143 | A | 10/1966 | Mommsen et al. |
| 3,302,946 | A | 2/1967 | Anderson |
| 3,332,324 | A | 7/1967 | Lehmacher et al. |
| 3,338,487 | A | 8/1967 | Schultz |
| 3,390,875 | A | 7/1968 | Beert et al. |
| 3,481,520 | A | 12/1969 | Pickering |
| 3,631,651 | A | 1/1972 | Kopp |
| 3,659,766 | A | 5/1972 | Alago |
| 3,672,551 | A | 6/1972 | Peterson |
| 3,675,542 | A | 7/1972 | Torigoe |
| 3,730,411 | A | 5/1973 | Brockmuller |
| 3,741,451 | A | 6/1973 | Parenti et al. |
| 3,748,937 | A | 7/1973 | Long |
| 3,777,958 | A | 12/1973 | Graham |
| 3,794,228 | A | 2/1974 | Colwill et al. |
| 3,797,822 | A | 3/1974 | Anderson |
| 3,847,318 | A | 11/1974 | Parenti et al. |
| 3,856,196 | A | 12/1974 | Bayne |
| 3,863,821 | A | 2/1975 | Van Bennekom |

(Continued)

FOREIGN PATENT DOCUMENTS

| | | |
|---|---|---|
| CA | 2013280 | 11/1990 |

(Continued)

*Primary Examiner*—Kenneth Noland
(74) *Attorney, Agent, or Firm*—Nicholas A. Kees; Godfrey & Kahn, S.C.

(57) ABSTRACT

A web burster/inserter assembly receives a continuous supply of coupons in the form of a web where the forwardmost coupon is attached to the following coupon. The web burster/inserter separates individual coupons from the web and directs the coupons to a desired location. A ram may be used to effectuate the separation. The web burster/inserter is capable of being used with coupons of varying thickness such as plastic prizes and game pieces.

25 Claims, 11 Drawing Sheets

U.S. PATENT DOCUMENTS 3,881,645 A 5/1975 Kopp
3,888,399 A 6/1975 Hanson et al.
3,894,669 A 7/1975 Wescoat
3,897,052 A 7/1975 Turman et al
3,908,983 A 9/1975 Long
3,929,326 A 12/1975 Seragnoli
3,964,638 A * 6/1976 Dimauro ..... 221/3
3,968,196 A 7/1976 Wiley
3,987,603 A 10/1976 Jelling et al.
3,991,924 A 11/1976 Schueler
4,022,364 A 5/1977 Davis
4,025,023 A 5/1977 Moffitt
4,039,181 A 8/1977 Prewer
4,060,168 A 11/1977 Romagnoli
4,069,957 A 1/1978 Moffitt
4,091,978 A 5/1978 Graham, II
4,118,022 A 10/1978 Rayfield et al.
4,131,272 A 12/1978 Hartnig
4,145,035 A 3/1979 Moser
4,179,113 A 12/1979 Gallimore
4,182,222 A 1/1980 Stahl
4,216,952 A 8/1980 McInerny
4,217,744 A 8/1980 Mizutani
4,222,511 A 9/1980 Schueler
4,261,497 A 4/1981 Roetter et al.
4,268,344 A 5/1981 Jones
4,284,221 A 8/1981 Nagel et al.
4,323,230 A 4/1982 Rising
4,345,753 A 8/1982 Marshall
4,351,517 A 9/1982 Neal et al.
4,354,894 A 10/1982 Lewis et al.
4,375,189 A 3/1983 Berner et al.
4,385,537 A 5/1983 Wolf
4,397,410 A 8/1983 Schueler
4,401,249 A 8/1983 Kadlecik et al.
4,412,631 A 11/1983 Haker
4,429,217 A 1/1984 Hill et al.
4,454,973 A 6/1984 Irvine
4,455,809 A 6/1984 Dllaserra
4,473,218 A 9/1984 Dudek
4,479,597 A 10/1984 Johnson et al.
4,498,894 A 2/1985 Kuckhermann
4,516,765 A 5/1985 Stocco et al.
4,524,557 A 6/1985 Silverman et al.
4,529,114 A 7/1985 Casper et al.
4,530,200 A 7/1985 Prewer
4,606,534 A 8/1986 Gombault
4,616,773 A 10/1986 Kerivan
4,623,081 A 11/1986 Hain et al.
4,651,983 A 3/1987 Long
4,658,564 A 4/1987 Bell, Jr. et al.
4,668,212 A 5/1987 Kotani
4,688,708 A 8/1987 Irvine et al.
4,696,145 A 9/1987 Schmidt et al.
4,717,043 A 1/1988 Groover et al.
4,825,622 A 5/1989 Nigg
4,929,226 A 5/1990 Focke et al.
4,982,337 A 1/1991 Burr et al.
4,999,974 A 3/1991 Kovacs et al.
5,079,901 A 1/1992 Kotsiopoulos
5,104,022 A 4/1992 Nakamura et al.
5,239,809 A 8/1993 Long
5,297,711 A 3/1994 Kogen
5,377,474 A 1/1995 Kovacs et al.
5,427,294 A 6/1995 Vander Menvel et al.
5,549,233 A 8/1996 Clauser
5,588,280 A 12/1996 Kotsiopoulos
5,640,891 A 6/1997 Hoffa
5,715,656 A 2/1998 Pearce
5,784,861 A 7/1998 Kotsiopoulos
5,785,224 A 7/1998 Nowakowski
5,845,462 A 12/1998 Kuehl et al.
5,966,906 A 10/1999 Kuehl et al.
6,082,079 A 7/2000 Kuehl et al.
6,206,262 B1 3/2001 Achelpohl et al.
6,257,475 B1 7/2001 Ishii et al.

FOREIGN PATENT DOCUMENTS

EP 0472624 3/1992
JP 53-31067 8/1978
JP 53-38997 10/1978

* cited by examiner

WEB BURSTER/INSERTER

CROSS-REFERENCE TO RELATED APPLICATION

This application is a continuation-in-part application of and claims benefit under 35 U.S.C. § 120 to U.S. patent application Ser. No. 09/680,892, filed on Oct. 6, 2000, now abandoned which is specifically incorporated herein by reference in its entirety for all purposes.

FIELD OF THE INVENTION

This invention relates generally to an apparatus for separating discrete pieces from a continuous web, and, in particular, to a web burster/inserter apparatus that can separate pieces of various sizes and shapes from a continuous web and place the separated pieces into containers that are moving along a high volume handling system or place the separated pieces into a desired location such as the fill tube of a form, fill, and seal bagging machine.

BACKGROUND OF THE INVENTION

It is a common advertising and promotional technique to place coupons, discount cards, prizes or other promotional materials into containers such as cartons for breakfast cereal or snack items or into bagged products such as potato chips. The coupon is highly visible to the consumer who can then use the coupon for the intended purpose, such as for discounts on future purchases or rebates. The coupon itself may also contain a prize or other premium, often a molded plastic figure or other piece. Accordingly, the term "coupon" used herein includes any type of insert, coupon, card, sheet, receipt, warranty, prize, premium, or other part that can be advantageously handled in accordance with the invention hereinafter described. Similarly, the terms "container" and "receiving product" are used in the broadest possible context to include containers such as boxes, tubs, cans, and vessels of all kinds as well as other coupon receiving objects that can be advantageously used with the present invention, such as the fill tube of a form, fill, and seal packaging machine.

Placing coupons by hand is very expensive as it is labor intensive and human hands cannot always keep up with the speed of modern automated packaging equipment. Thus, packaging equipment manufacturers have developed a variety of automated coupon inserter machines for placing coupons on or into products. Typically, coupon inserting devices operate by discharging or positioning a single coupon in each container rapidly moving along a conveyor system or into a chute or tube of some other type of product handling system. There are several methods and apparatus for placing single coupons. One requires a stack of pre-cut coupons that are individually dispensed from a downwardly sloping channel, such as the system shown in Prewer, U.S. Pat. No. 4,530,200. In that system, pusher elements and advancing rollers coact to withdraw the forwardmost coupon from the pre-cut stack. The coupon is then drawn into the downwardly sloping channel to a dispensing location. In another apparatus, shown in Gallimore, U.S. Pat. No. 4,197,113, a reciprocal vacuum head picks a coupon from a stack of pre-cut coupons and places the coupon on a conveyor system, which in turn transports the coupons to the containers. Another system, shown in Lewis et al., U.S. Pat. No. 4,354,894, requires the use of a mechanical cutting device to separate each coupon from a continuous web. Once separated, the coupons are dispensed to the containers using a conveyor system. In yet another system, a device separates a single coupon from a continuous web of coupons using a bursting technique and places the coupon into the container or places the coupon into the fill tube of a form-fill-seal packaging system. Such devices are disclosed in U.S. Pat. Nos. 5,845,462 and 6,082,079, respectively, which are assigned to the assignee of the present invention. While such systems are generally effective with flat coupons, they have not been found to be entirely effective for use in connection with thick or bulky coupons such as overwrapped plastic prizes or parts (such coupons shall be referred to herein generally as "three-dimensional coupons"). This invention relates to an improved coupon delivery system as compared to the systems described above and to solutions to some of the problems raised or not solved thereby.

SUMMARY OF THE INVENTION

The present invention provides a burster-type coupon insertion machine that is capable of handling three-dimensional coupons without damaging the coupon. The coupon insertion machine quickly and reliably dispenses a coupon with each activation of the device and is capable of reliably operating at high speeds. The coupon insertion machine is further capable of separating a variety of coupon sizes, shapes, and burst strengths and includes an integrated coupon delivery mechanism to provide a highly reliable coupon insertion machine at a reasonable price. The coupon inserter in accordance with the present invention easily dispenses overwrapped three-dimensional coupons such as toys, prizes, and other objects. These and other advantages of the present invention will become apparent from the detailed description, claims, and accompanying drawings.

One embodiment of an inserter manufactured in accordance the present invention includes an infeed assembly, a delivery assembly, a ram, a controller, and a number of sensors and motors. Both the infeed and the delivery assemblies include upper and lower belts that are disposed around rollers. The upper and lower belts are functionally connected to one another by a biased linkage. This linkage allows either one or both of the belts to move so as to accommodate coupons of varying dimensions. The lower belts are driven by motors and are fixed in position. In one embodiment, the upper belts are not power-driven and are adjustable and spring-biased. In another embodiment, the upper belts are driven by the same motors driving the lower belts using a drive belt including an automatic tensioning device so as to allow movement of the upper belt. The controller receives input from an activation input, the coupon staging sensor, and the coupon delivery sensor and controls the operation and speed of the infeed assembly, the delivery assembly and the ram. The coupon staging sensor is mounted between the infeed and delivery assemblies and is adjacent the ram. The coupon delivery sensor is mounted beyond the delivery assembly. A container sensor that functions as the activation input is positioned with respect to the production conveyor line such that it can detect the packages into which the coupons are to be inserted. In the case where the device is to be used with a form, fill, and seal packaging machine, the activation input is connected to the form, fill, and seal packaging machine, and is typically linked to a "dump" signal from a statistical weighing machine.

In one embodiment, the device is used with a perforated or otherwise weakened web of coupons and a dull ram end is used in the ram. In another embodiment, a non-perforated web of coupons is used, and a sharp knife end is used in the ram to ensure a clean separation. While it has been found effective to use a pneumatic ram, other electrical or mechanical configurations such as a servo-motor driven ram could also be used. Such an embodiment is particularly useful where a pneumatic power source is not available near the product manufacturing line.

The coupon inserter has a relatively simple operational sequence. In one embodiment, the motor driving the delivery assembly is stopped and started during operation of the coupon inserter. In another embodiment, the motor driving the delivery assembly is continually running during operation of the coupon inserter.

In one embodiment, the motor operating the delivery assembly and the delivery assembly itself are stopped and started. In the embodiment where the three-dimensional coupons are being placed into containers moving along a conveyor or other product handling device, prior to any containers coming down the line, a continuous web of coupons is fed into the infeed assembly and a coupon is staged in the delivery assembly. When a container comes down the line, the container sensor identifies the container and sends an activation signal to the controller through the activation input. The motor connected to the delivery assembly is then activated by the controller to rapidly deliver the pre-staged coupon into the container. At the same time, the infeed assembly slightly backs-up the coupon web to ensure that the area near the coupon staging sensor is clear. When the pre-staged coupon passes the coupon delivery sensor, the motor attached to the infeed assembly begins forward rotation. At the same time, the motor operating the delivery assembly is slowed to match the speed of the infeed assembly. The now moving infeed assembly causes the web of coupons to be fed toward the delivery assembly. The coupon staging sensor senses the presence of the leading edge of the forwardmost coupon and, depending on coupon length, after a short delay, both motors stop thereby placing the thin portion of the web (perforated or otherwise weakened in one embodiment) between the two coupons immediately below the ram. After the web stops moving, the ram fires, breaking the coupons apart. After separation, the now-separated forwardmost coupon is staged in the delivery assembly to await the next signal from the activation input (a container sensor in this embodiment). The process is repeated each time a container passes the container sensor.

If the inserter is used with a form, fill, and seal packaging machine, when the activation input receives a signal from the form, fill, and seal packaging machine, the signal is transmitted to the controller. The motor connected to the delivery assembly is then activated by the controller to rapidly deliver the pre-staged coupon into the fill tube. At the same time, the infeed assembly slightly backs-up the coupon web to ensure that the area near the coupon staging sensor is clear. When the pre-staged coupon passes the coupon delivery sensor, the motor attached to the infeed assembly begins forward rotation. At the same time, the motor operating the delivery assembly is slowed to match the speed of the infeed assembly. The now rotating infeed assembly causes the web of coupons to be fed toward the delivery assembly. The coupon staging sensor senses the presence of the leading edge of the forwardmost coupon and, depending on coupon length, after a short delay, both motors stop thereby placing the thin portion of the web (perforated or otherwise weakened in one embodiment) between the two coupons immediately below the pneumatic ram. After the web stops moving, the ram fires, breaking the coupons apart. After separation, the now-separated forwardmost coupon is staged in the delivery assembly to await the next activation signal from the form, fill, and seal packaging machine. The process is repeated each time an activation signal is received by the activation input from the form, fill, and seal packaging machine.

In another alternative embodiment, the ram is not used. In this embodiment, which may be used in a conveyor-line installation, in a form, fill, and seal packaging machine installation, or in any other suitable environment, the operational process is slightly different. Installation in an environment where the three-dimensional coupons are being placed into containers moving along a conveyor is used for illustrative purposes. Prior to any containers coming down the line, a continuous web of coupons is fed into the infeed assembly and a coupon is staged in the delivery assembly. When a container comes down the line, the container sensor identifies the container and sends an activation signal to the controller through the activation input. The motor connected to the delivery assembly is then activated by the controller to rapidly deliver the pre-staged coupon into the container. When the pre-staged coupon passes the coupon delivery sensor, the motor attached to the infeed assembly begins moving. At the same time, the motor operating the delivery assembly is slowed to match the speed of the infeed assembly. The now rotating infeed assembly causes the web of coupons to be fed toward the delivery assembly. The coupon staging sensor senses the presence of the leading edge of the forwardmost coupon and, depending on coupon length, after a short delay, both motors stop thereby placing the perforated portion of the web between the two coupons between the infeed assembly and the delivery assembly. After the web stops moving, the infeed assembly reverses direction so as to apply a tension to the web thereby breaking the coupons apart at the perforation. After separation, the now-separated forwardmost coupon is staged in the delivery assembly to await the next activation signal from the container sensor and the continuous web remains held in the infeed assembly. The process is repeated each time a container passes the container sensor.

In another embodiment, the motor operating the delivery assembly and the delivery assembly itself are continually running. In one embodiment, the delivery assembly has at least one delivery belt that is continuously moving. The continuous web is fed into the infeed assembly thereby securing the continuous web between the upper infeed belt and the lower infeed belt of the infeed assembly. The infeed assembly advances the continuous web a predetermined length/distance toward a continuously running delivery assembly. Such advancement causes the continuous web to come into contact and engage the delivery assembly. Once the continuous web has been advanced the predetermined length/distance, the infeed assembly is stopped thereby stopping movement of the continuous web. In one embodiment the infeed assembly is stopped when a web portion between successive coupons is positioned between the infeed assembly and the delivery assembly. The infeed assembly then retracts the continuous web the predetermined length/distance from the continuously running delivery assembly. The advancement and retraction of the continuous web while the web is in contact with the continuously running delivery assembly acts to separate the forwardmost coupon from the continuous web. In one embodiment, a ram or knife strikes the continuous web near the web portion to help separate the forwardmost coupon from the continuous web. The delivery assembly then moves the forwardmost coupon to a desired delivery location.

DETAILED DESCRIPTION

Figure 1:
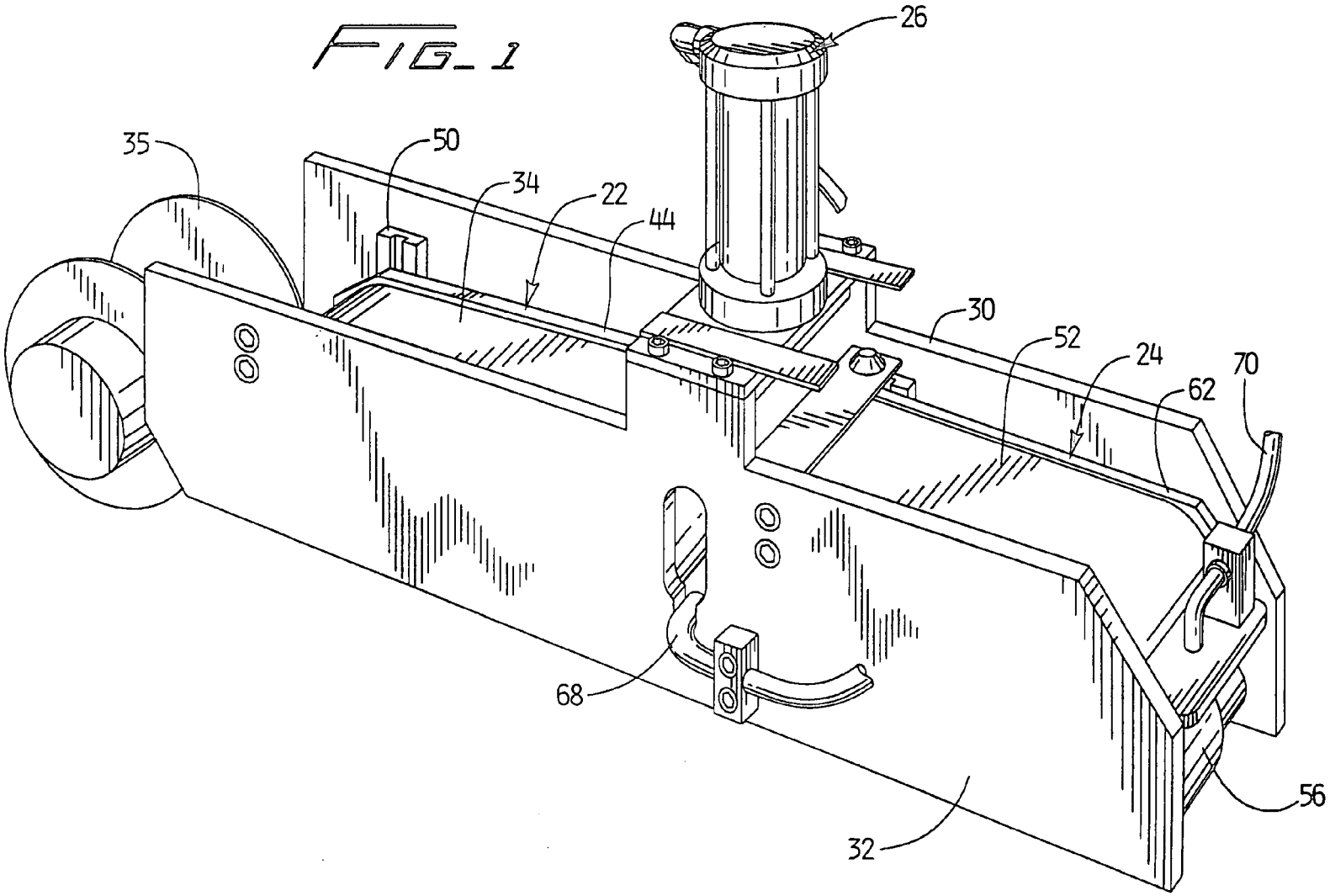
FIG. 1 is a perspective view of a coupon inserter in accordance with one embodiment of the invention.

FIGS. 1–4 show a coupon inserter (identified generally as 20) manufactured in accordance with one embodiment of the present invention. The coupon inserter 20 includes an infeed assembly 22, a delivery assembly 24, a ram 26, a controller 28 (see FIG. 3), and a number of sensors and motors that are assembled together on a first frame piece 30 and a second frame piece 32. A coupon source, such as the roll 35 shown in FIG. 1, is used to supply bandoleer format coupons to the coupon inserter 20.

The infeed assembly 22 includes an upper infeed belt 34 disposed about upper infeed rollers 34 and a lower infeed belt 36 disposed around lower infeed rollers 40. In one embodiment, the upper infeed belt 34 and the lower infeed belt 36 are functionally connected to one another by a biased linkage 48. The biased linkage 48 can take a variety of forms such as springs, belts, hydraulics, pneumatics, any combination thereof, or the like. The biased linkage 48 allows the infeed assembly 22 to accommodate three-dimensional coupons. While, as shown in FIG. 4, using three rollers for each belt has been found to be an effective design, other numbers of rollers and belt configurations could certainly be used. In the embodiment shown in FIG. 3, at least one of the lower infeed rollers 40 is driven by infeed drive motor 42 which in turn causes the lower infeed belt 38 to move. In this embodiment, the upper infeed belt 34 is not power-driven but is caused to move by the coupons between the lower infeed belt 38 and the upper infeed belt 34 and/or a linkage between the upper infeed belt 34 and the lower infeed belt 38. In an alternative embodiment, the upper infeed belt 34 is power-driven by infeed drive motor 42 and an automatic tensioning device is used to maintain a connection between the upper infeed belt 34 and the infeed drive motor 42 when the upper infeed belt 34 moves to accommodate a three-dimensional coupon. In still another embodiment, both the upper infeed belt 34 and the lower infeed belt 36 are power-driven by infeed motor 42. It has been found effective to use a stepper motor, such as the QCI 34-H-1-E-01 motor manufactured by Quicksilver Controls or the 34N1125-LW8 motor manufactured by Anaheim Automation for infeed drive motor 42 although a servo motor or other type of motor that can be selectively driven at a variety of speeds could also be effectively used.

In one embodiment, upper infeed belt 34 and upper delivery belt 52 are moveable so as to accommodate three-dimensional coupons. This is accomplished by allowing the first and second upper infeed frame pieces 44 and 46 to move with respect to first and second frame pieces 30 and 32 so as to allow a gap sufficient to accommodate the three-dimensional coupon between upper infeed belt 34 and lower infeed belt 38. Similarly, in this embodiment, the first and second upper delivery frame pieces 62 and 64 are also allowed to move with respect to first and second frame pieces 30 and 32 so as to allow a gap sufficient to accommodate the three-dimensional coupon. In an alternative embodiment, lower infeed frame pieces 43 and lower delivery frame pieces 60 are allowed to move with respect to first and second frame pieces 62 and 64 so as to accommodate the three-dimensional coupon.

Figure 2:
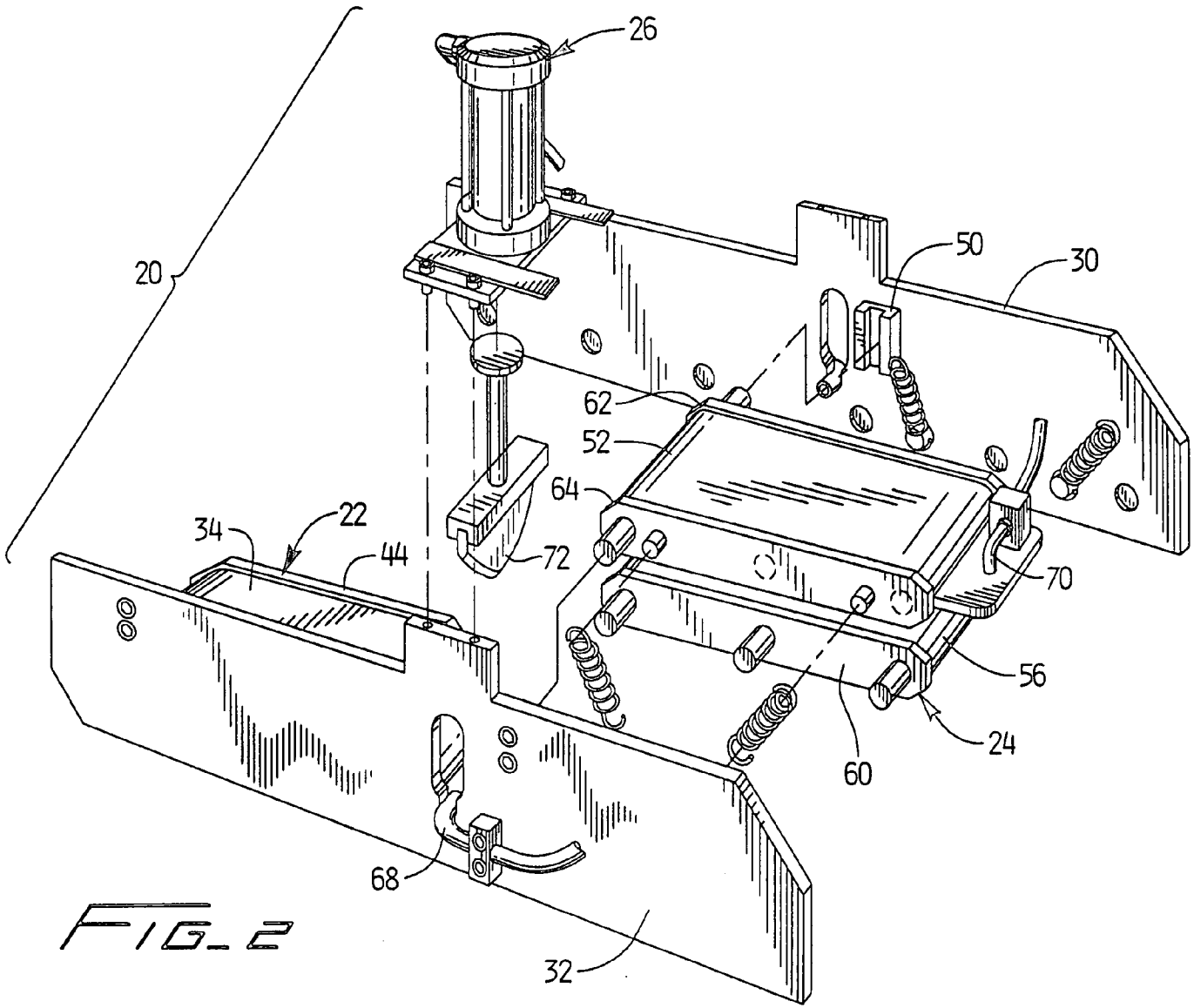
FIG. 2 is a partially-exploded perspective view of a coupon inserter in accordance with the embodiment of the invention shown in FIG. 1.

As best seen by reference to FIGS. 2 and 4, upper infeed rollers 36 are secured between a first upper infeed frame piece 44 and a second upper infeed frame piece 46 (FIG. 3), each of which may have one or more posts 47 extending therefrom. First upper infeed frame piece 44 is attached to first frame piece 30 such that posts 47 fall within a guide track 50 on the first frame piece 30. Similarly, second upper infeed frame piece 46 is attached to the second frame piece 32 such that posts 47 fall within a similar guide track 50 on the second frame piece 32. While one post 47/guide track 50 configuration is shown on each side of the infeed assembly 22, additional such combinations may be used to further stabilize the infeed assembly 22. Because of this manner of securing the upper infeed rollers 36, the upper infeed belt 34 is allowed to move with respect to the lower infeed belt 38 so as to accommodate coupons of varying dimensions. The pressure on the coupons in the infeed assembly 22 is adjusted by using a biased linkage 48 of varying tension or resistance, adjusting the tension of resistance of the biased linkage 48, and/or by adjusting stops within the guide tracks 50. The infeed assembly 22 may also be configured such that the upper infeed belt 34 is fixed and driven and the lower infeed belt 38 is the one that is free to move to accommodate the three-dimensional coupon.

Like the infeed assembly 22, the delivery assembly 24 includes an upper delivery belt 52 disposed about upper delivery rollers 54 and a lower delivery belt 56 disposed around lower delivery rollers 58. In one embodiment, the upper delivery belt 54 and the lower delivery belt 56 are functionally connected to one another by a biased linkage 48. The biased linkage 48 can take a variety of forms such as springs, belts, hydraulics, pneumatics, any combination thereof, or the like. The biased linkage 48 allows the delivery assembly 24 to accommodate three-dimensional coupons. While, as shown in FIG. 4, three rollers for each belt has been found to be an effective design, other numbers of rollers and belt configurations could certainly be used. In the embodiment shown in FIG. 3, one of the lower delivery rollers 58 is driven by delivery drive motor 59 which in turn causes the lower delivery belt 56 to move. In this embodiment, the upper delivery belt 52 is not power-driven but is caused to move by the coupons between the lower delivery belt 56 and the upper delivery belt 52 and/or a linkage between the upper delivery belt 52 and the lower delivery belt 56. In one embodiment, the biased linage 48 functions to move the upper delivery belt 52. It has been found effective to use a stepper motor for delivery drive motor 59, preferably, for ease of maintenance and replacement, of the same type as the infeed drive motor 42, although another type of motor that can be selectively driven at a variety of speeds could also be effectively used. In another embodiment, the upper delivery belt 52 is power-driven and lower delivery belt 56 is not. In still another embodiment, both the upper delivery belt 52 and the lower delivery belt 56 are power-driven.

As best seen by reference to FIGS. 2 and 4, upper delivery rollers 54 are secured between a first upper delivery frame piece 62 and a second upper delivery frame piece 64 (FIG. 3), each of which may have one or more posts 47 extending therefrom. First upper delivery frame piece 62 is attached to first frame piece 30 such that posts 47 fall within another guide track 50 on the first frame piece 30. Similarly, second upper delivery frame piece 64 is attached to the second frame piece 32 such that posts 47 fall within yet another guide track 50 on the second frame piece 32. While one post 47/guide track 50 combination is shown on each side of the delivery assembly 24, additional such combinations could be used to further stabilize the delivery assembly 24. Because of this manner of securing the upper delivery rollers 54, the upper delivery belt 52 is allowed to move with respect to the lower delivery belt 56 so as to accommodate coupons of varying dimensions. As in the infeed assembly 22, the pressure on the coupons is adjusted by using a biased linkage of varying tension or resistance, adjusting the tension or resistance of the biased linkage 48, and/or by using stops within the guide tracks 50. The delivery assembly 24 may also be configured such that the upper delivery belt 52 is fixed and driven and the lower delivery belt 56 is free to move and not driven.

Figure 1A:
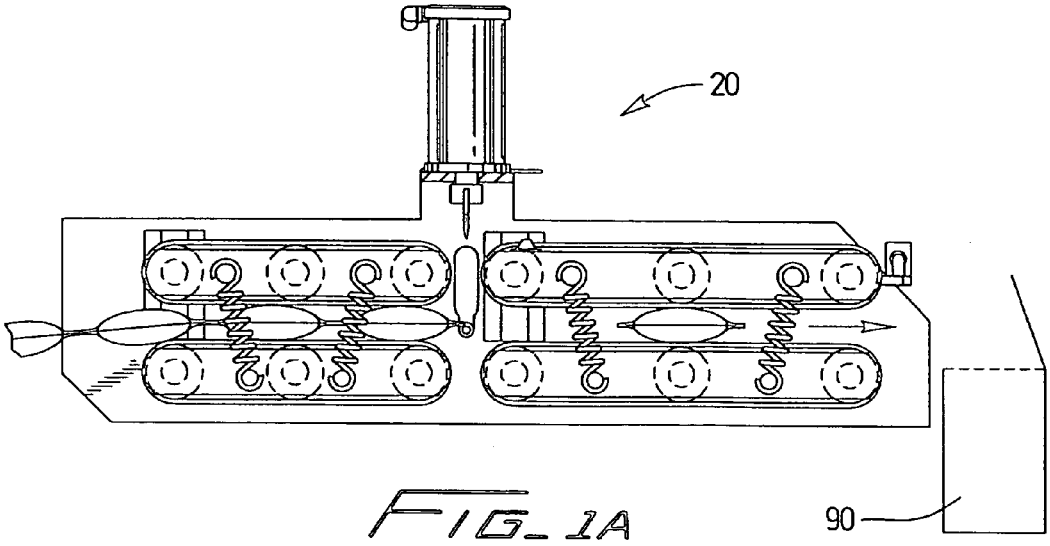
FIG. 1A is a side elevational view of a coupon inserter in accordance with the embodiment of the invention shown in FIG. 1, shown with the second frame piece removed and installed to deliver coupons to containers.
Figure 3:
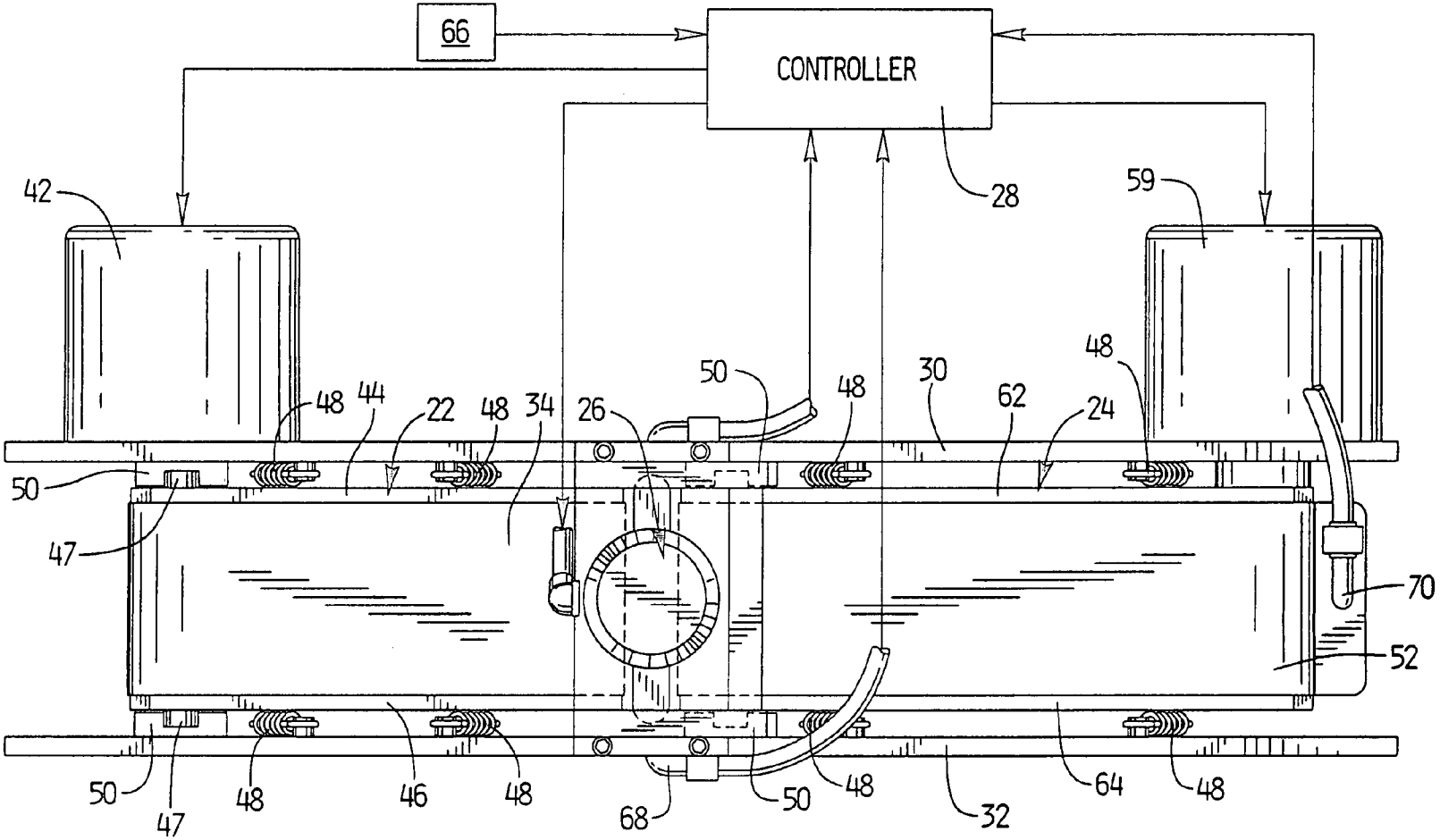
FIG. 3 is a top plan view of a coupon inserter in accordance with the embodiment of the invention shown in FIG. 1 with links to a controller shown schematically.
Figure 4:
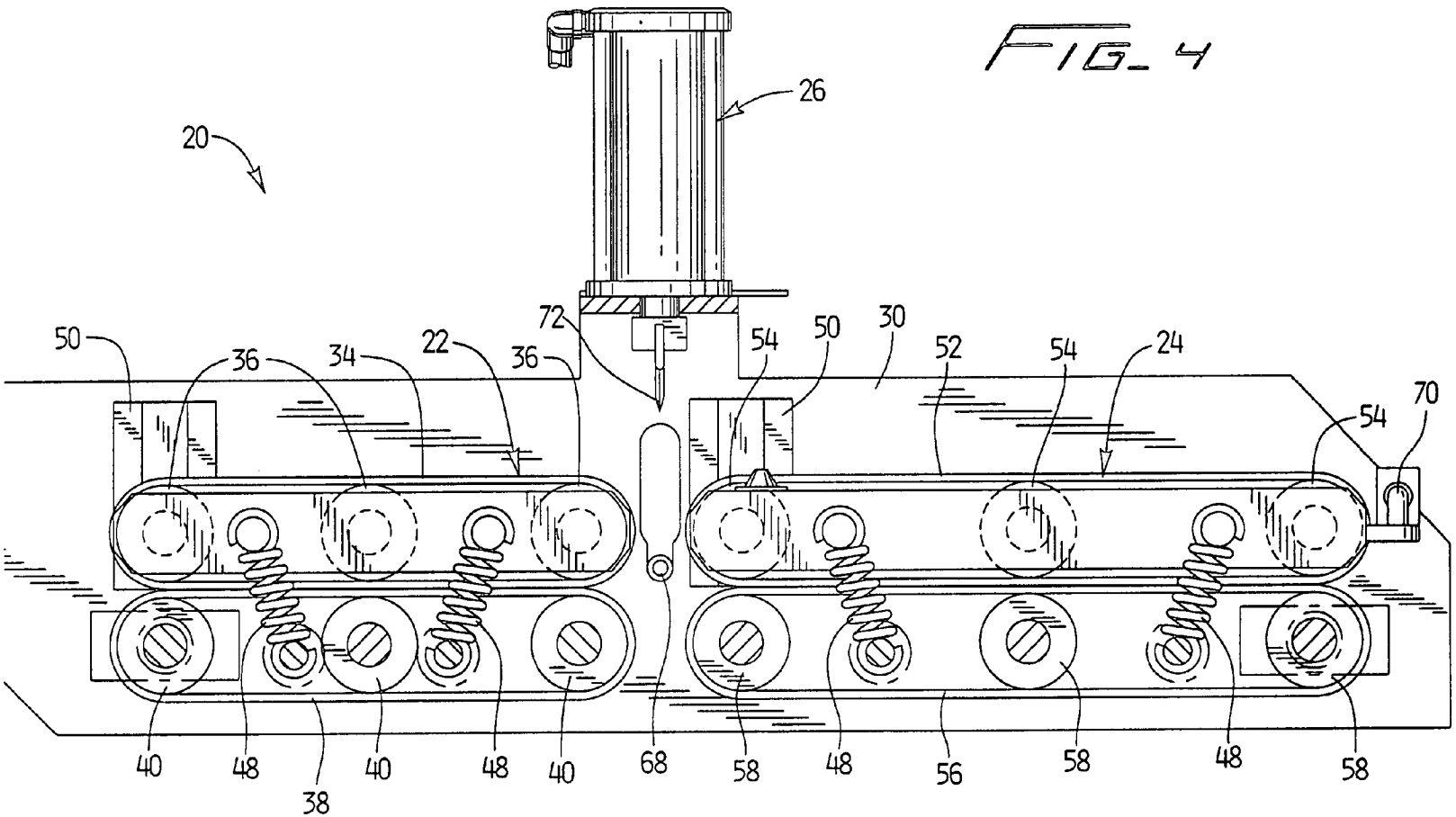
FIG. 4 is a side elevational view of a coupon inserter in accordance with the embodiment of the present invention shown in FIG. 1, shown with a second frame piece removed.

As shown in FIG. 3, a controller 28 is used to control the operation of the coupon inserter 20. The controller 28 may be a programmable logic control device or other device of similar capabilities such as a computer. The controller 28 receives signals from an activation input 66, a coupon staging sensor 68, and the coupon delivery sensor 70. The activation input 66 may be a container sensor where the coupon inserter 20 is installed to place coupons into boxes 90 moving along a conveyor line (FIG. 1A), may be attached to a form, fill, and seal machine where the coupon inserter 20 is installed to place coupons into the fill tube 92 of the machine (FIG. 1B), or may be attached to any other device that is being used to activated the coupon inserter 20 in a particular installation. The coupon staging sensor 68 is mounted on the first frame piece 30 between the infeed assembly 22 and delivery assembly 24 adjacent the ram 26. The coupon delivery sensor 70 is mounted beyond the delivery assembly 24 such that it can sense a coupon being dispensed from the coupon inserter 20. Based on signals from the activation input 66, the coupon staging sensor 68, and the coupon delivery sensor 70, and any time delay and speed settings that are required for a particular application, the controller 28 controls (1) the operation and speed of the infeed assembly 22 by controlling infeed drive motor 42; (2) the operation and speed of the delivery assembly 24 by controlling delivery drive motor 59; and (3) the breaking of the coupon web by controlling the function of the ram 24.

Ram 26 is attached to the first and second frame pieces, 30 and 32, of the coupon inserter 20 and is positioned between the infeed assembly 22 and the delivery assembly 24. Other means of positioning the ram 26 within the coupon inserter 20 could also be used. In the embodiment where a pneumatic ram is used, it has been found effective to use the Bimba Flat 2 device manufactured by Bimba Manufacturing Company. In the embodiment where an electromechanical ram is used, it has been found effective to use the QCI-17H-3-01 device manufactured by Quicksilver Controls. In one embodiment, the coupon inserter 20 is used with a bandoleer format coupon where each successive coupon is connected to the next one with a perforated or otherwise weakened web portion in between each. If such coupons are used, a dull wedge is used as ram end 72 in the ram 26. In another embodiment, a non-perforated web of coupons is used, and a sharp knife is used as ram end 72 in the ram 26 to ensure a clean separation of the coupon from the web.

The coupon inserter 20 has a relatively simple operational sequence. In one embodiment, the motor driving the delivery assembly 24 and the delivery assembly 24 are stopped and started during operation of the coupon inserter 20. In another embodiment, the motor driving the delivery assembly 24 and the delivery assembly 24 are continually running during operation of the coupon inserter 20.

Figure 5:
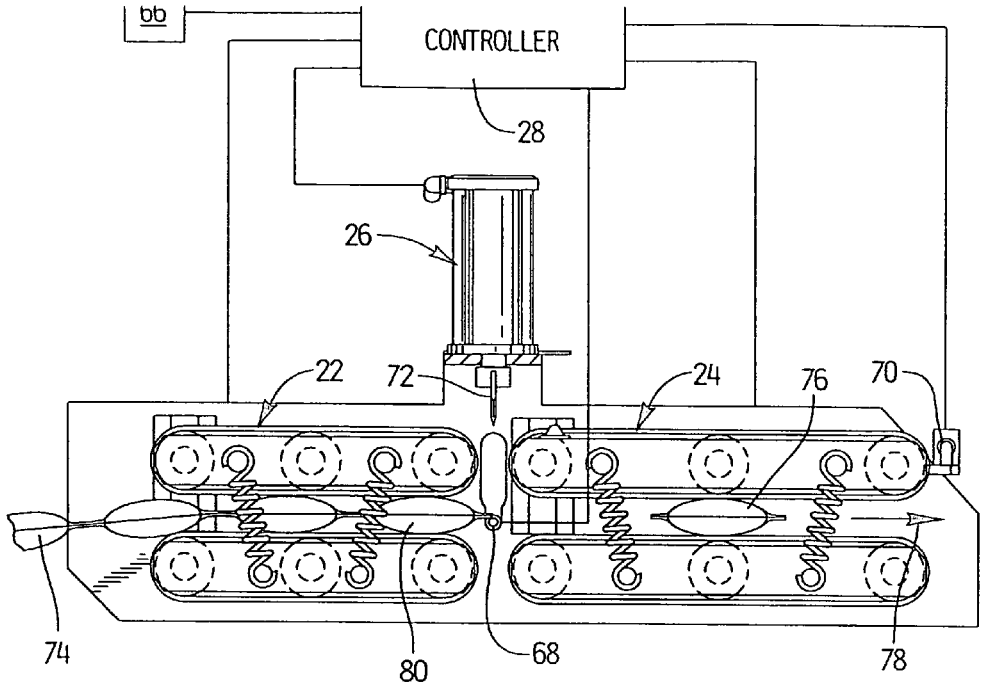
FIGS. 5–8 illustrate the operational sequence of a coupon inserter in accordance with one embodiment of the present invention with FIG. 5 schematically showing connections between the controller and the inserter.
Figure 6:
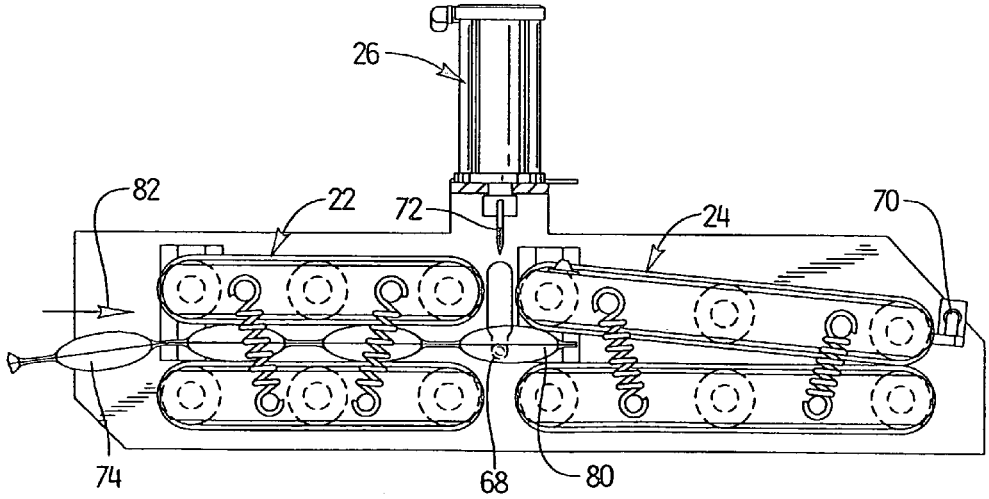
Figure 7:
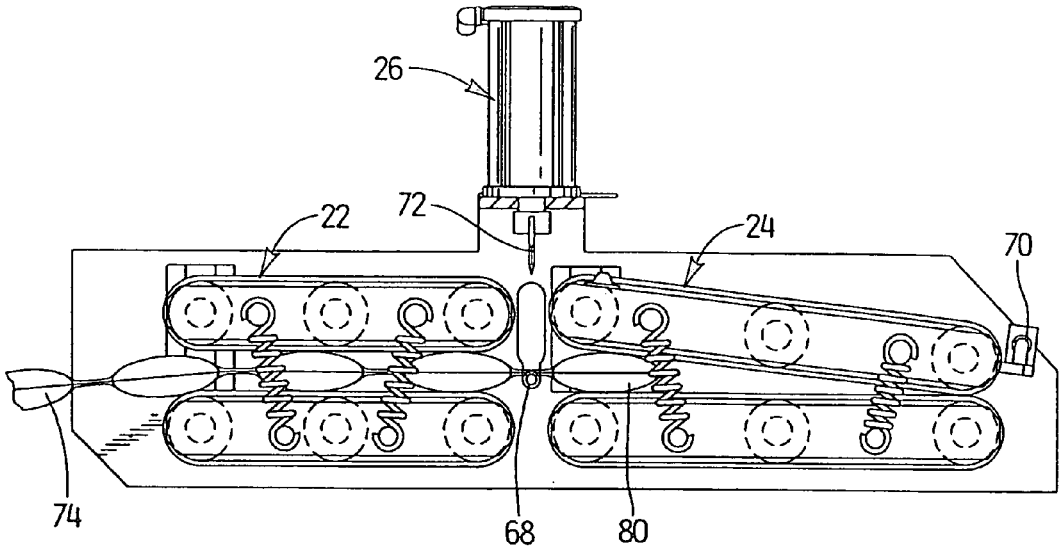
Figure 8:
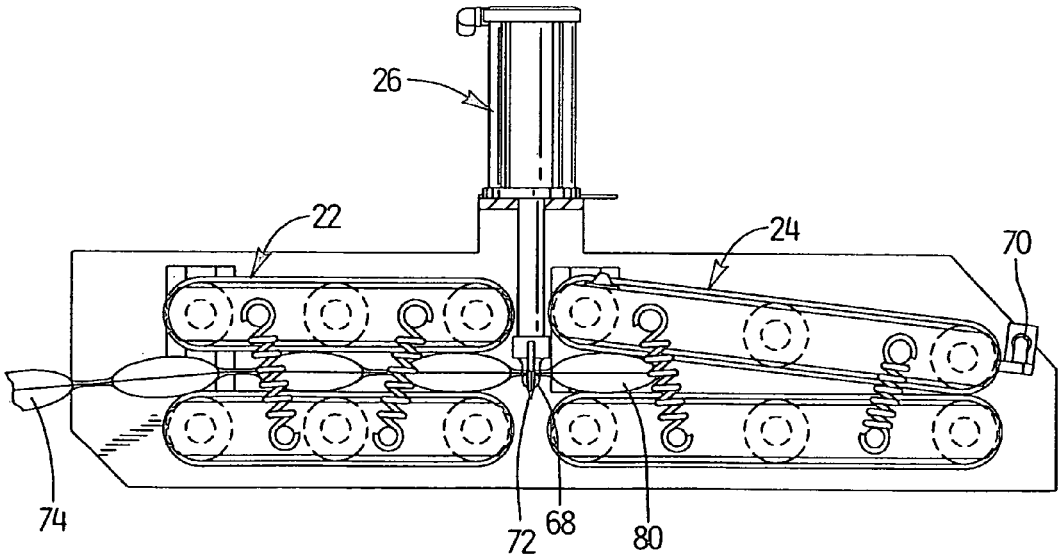

In one embodiment, the motor driving the delivery assembly 24 is stopped and started. In the embodiment shown in FIGS. 5–8 where the three-dimensional coupons are being placed into containers moving along a conveyor or other product handling device (FIG. 1A), prior to any containers 90 coming down the line, a continuous web of coupons 74 is fed into the infeed assembly 22 and a pre-staged coupon 76 is staged in the delivery assembly 24 (FIG. 5). When a container 90 comes down the line, the activation input 66 (in this case a container sensor that identifies the container) sends a signal to the controller 28. The delivery drive motor 59 connected to the delivery assembly 24 is then activated by the controller 28 to rapidly deliver the pre-staged coupon 76 into the container as indicated by arrow 78. At the same time, by operation of the infeed drive motor 42, the infeed assembly 22 slightly backs-up the coupon web 74 to ensure that the area near the coupon staging sensor 68 is clear. When the pre-staged coupon 76 passes the coupon delivery sensor 70 and is inserted into the container 90, the infeed drive motor 42 attached to the infeed assembly 22 begins moving so as to advance the coupon web 74 as indicated by arrow 82 (FIG. 6). At the same time, the delivery drive motor 59 moving the delivery assembly 24 is slowed to match the speed of the infeed assembly 22. The now moving infeed assembly 22 causes the web of coupons 74 to be fed toward the delivery assembly 24 (FIG. 7). The coupon staging sensor 68 senses the presence of the leading edge of the forwardmost coupon 68 and, after a short delay determined by the coupon length and the speed of the infeed assembly 22, both the infeed drive motor 42 and the delivery drive motor 59 stop thereby placing the thin portion of the web (perforated in one embodiment) between two coupons immediately below the ram 26. After the coupon web 74 stops moving, the ram 26 fires causing the ram end 72 to break (or cut in the knifed embodiment) the coupons apart (FIG. 8). After separation, the now-separated forwardmost coupon 80 is staged in the delivery assembly 24 to await the next signal from the activation input. The process is repeated each time a container 90 passes the container sensor.

Figure 1B:
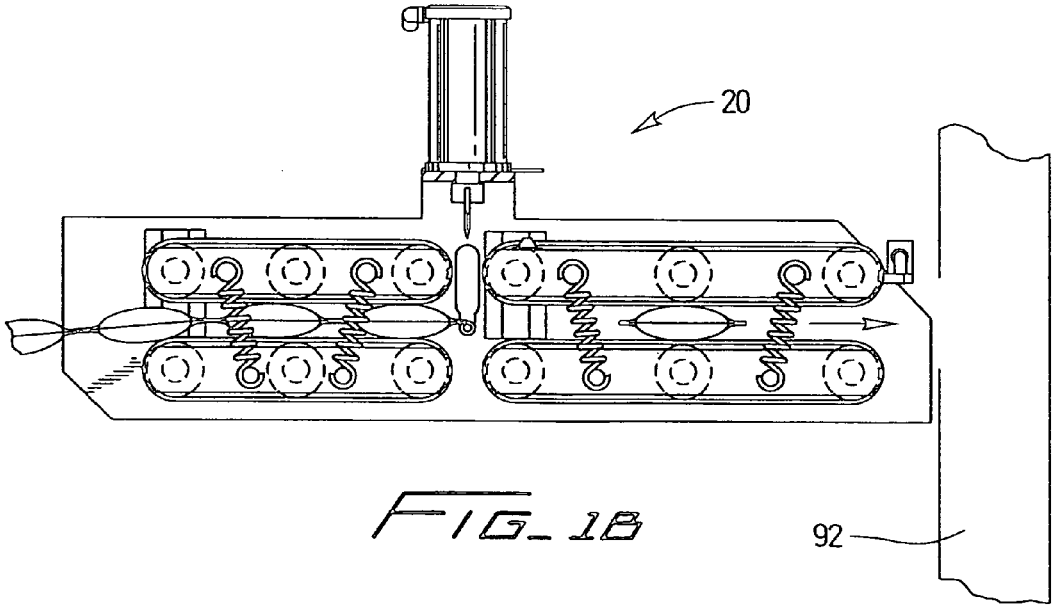
FIG. 1B is a side elevational view of a coupon inserter in accordance with the embodiment of the invention shown in FIG. 1, shown with the second frame piece removed and installed to deliver coupons to the fill tube of a form, fill, and seal machine.

Also illustrated in FIGS. 5–8, is the operation of the embodiment where the coupon inserter 20 is used with a form, fill, and seal packaging machine to place the coupons into the fill tube 92 of the machine (FIG. 1B). When the activation input 66 receives a signal from the form, fill, and seal packaging machine, it forwards that signal to the controller 28. The delivery drive motor 59 connected to the delivery assembly 24 is then activated by the controller 28 to rapidly deliver the pre-staged coupon 76 into the fill tube 92 of the form, fill, and seal machine (FIG. 5). At the same time, the infeed drive motor 42 attached to the infeed assembly 22 slightly backs-up the coupon web 74 to ensure that the area near the coupon staging sensor 68 is clear. When the pre-staged coupon 76 passes the coupon delivery sensor 70, the infeed drive motor 42 attached to the infeed assembly 22 begins moving so as to advance the coupon web 74. At the same time, the delivery drive motor 59 operating the delivery assembly 24 is slowed to match the speed of the infeed assembly 22. The now moving infeed assembly 22 causes the web of coupons 74 to be fed toward the delivery assembly 24 (FIG. 6). The coupon staging sensor 68 senses the presence of the leading edge of the forwardmost coupon 68 and, depending on coupon length, after a short delay, both the infeed drive motor 42 and the delivery drive motor 59 stop, thereby placing the thin portion of the web (perforated in one embodiment) between the two coupons immediately below the ram 26 (FIG. 7). After the web stops moving, the ram 26 fires causing the ram end 72 to break (or cut in the knifed embodiment) the coupons apart (FIG. 8). After separation, the now-separated forwardmost coupon 68 is staged in the delivery assembly 24 to await the next signal from the form, fill, and seal packaging machine through the activation input 66. The process is repeated each time an activation signal is received from the form, fill, and seal packaging machine to indicate that a coupon should be placed into the fill tube 92.

Figure 9:
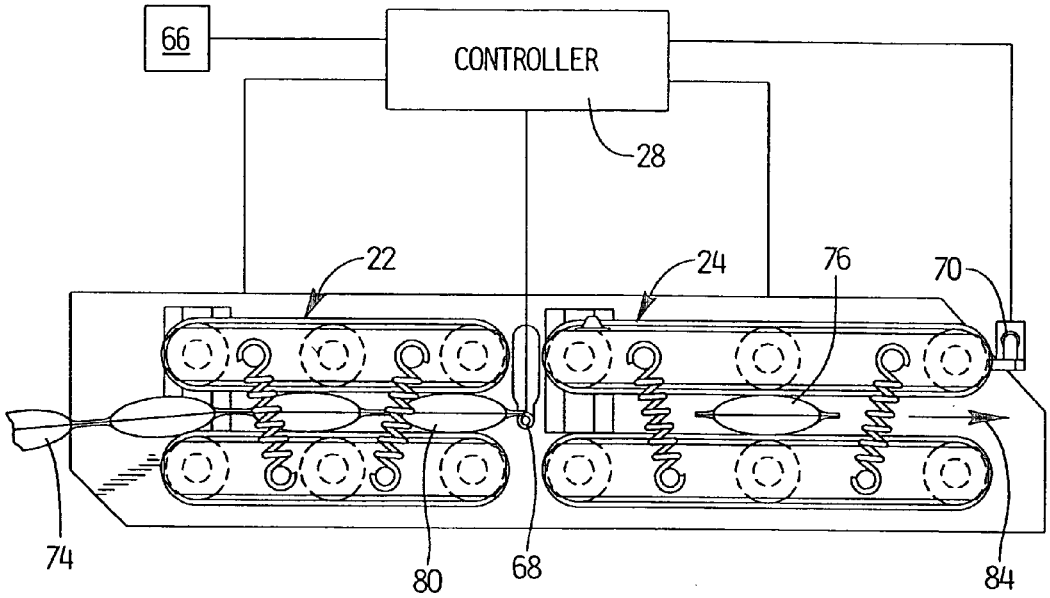
FIGS. 9–12 illustrate the operation sequence of a coupon inserter in accordance with one embodiment of the present invention with FIG. 9 schematically showing connections between the controller and the inserter.
Figure 10:
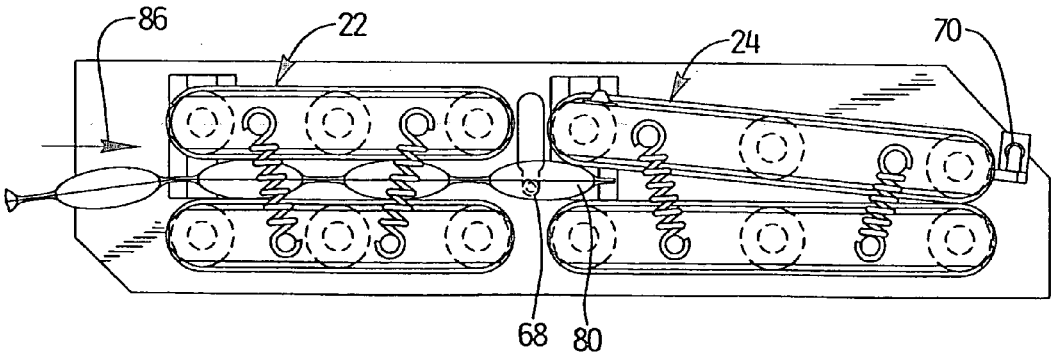
Figure 11:
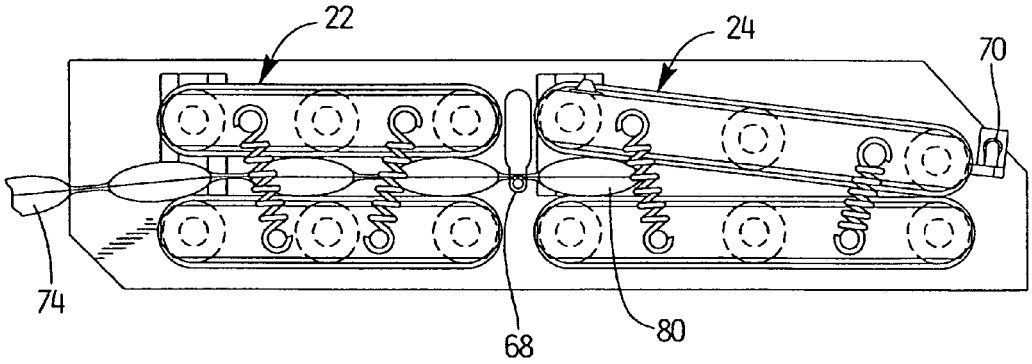
Figure 12:
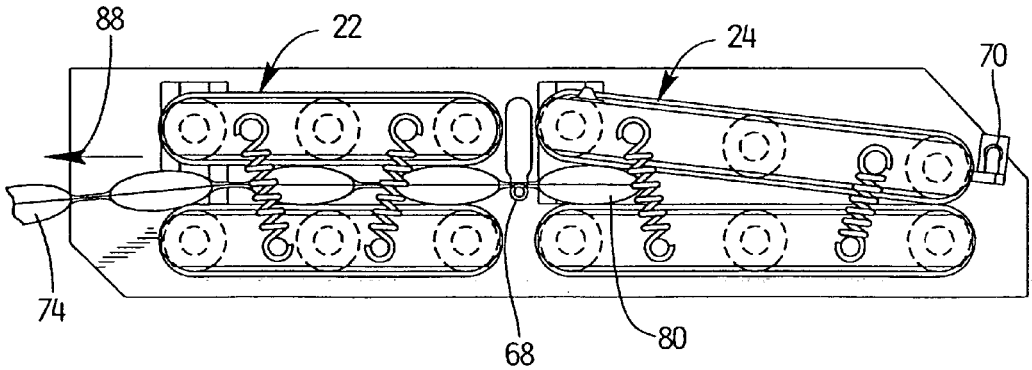
Figure 13:
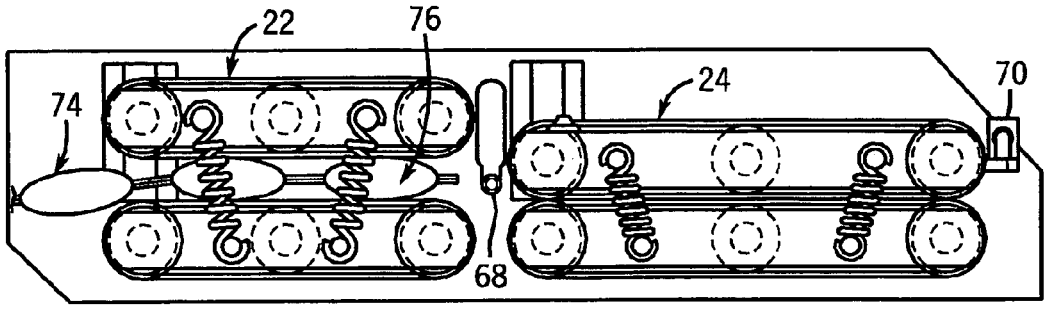
FIGS. 13–15 illustrates the operation and sequence of a coupon inserter in accordance with one embodiment of the present invention with FIG. 13 schematically showing connections between the controller and the inserter; and, FIGS. 16–18 illustrate the operation and sequence of a coupon inserter in accordance with one embodiment of the present invention with FIG. 16 schematically showing connections between the controller and the inserter.

In another embodiment, shown in FIGS. 9–12, the ram 26 is not used. In this embodiment, which may be used in a conveyor-line installation, in a form, fill, and seal packaging machine installation, or in any other suitable environment, the operational process is somewhat similar and the following description of installation in an environment where the three-dimensional coupons are being placed into containers 90 moving along a conveyor is used for illustration purposes only. As shown in FIG. 9, prior to any containers coming down the line, a continuous web of coupons 74 is fed into the infeed assembly 22 and a pre-staged coupon 76 is staged in the delivery assembly 24. When a container 90 comes down the line, the activation input 66 (in this case a container sensor that identifies the container) sends a signal to the controller 28. The delivery drive motor 59 connected to the delivery assembly 24 is then activated by the controller 28 to rapidly deliver the pre-staged coupon 76 into the container 90 as indicated by arrow 84. When the pre-staged coupon 76 passes the coupon delivery sensor 70, the infeed drive motor 42 attached to the infeed assembly 22 begins moving the coupon web 74 toward the delivery assembly 24 as indicated by arrow 86 in FIG. 10. At the same time, the delivery drive motor 59 operating the delivery assembly 24 is slowed to match the speed of the infeed assembly 22. The coupon staging sensor 68 senses the presence of the leading edge of the forwardmost coupon 80 and, depending on coupon length, after a short delay, both the infeed drive motor 42 and the delivery drive motor 59 stop, thereby placing the perforated portion of the web between the infeed assembly 22 and the delivery assembly 24 (FIG. 11). After the coupon web 74 stops moving, the infeed drive motor 42 reverses direction as indicated by arrow 88 in FIG. 12, causing the infeed assembly 22 to also reverse direction so as to apply a tension to the web, thereby breaking the forwardmost coupon 80 apart from the web 74 at the perforation. After separation, the now-separated forwardmost coupon 80 is staged in the delivery assembly 24 to await the next signal from the activation input 66 and the continuous web 74 remains held in the infeed assembly 22. The process is repeated each time a container passes the container sensor.

Figure 14:
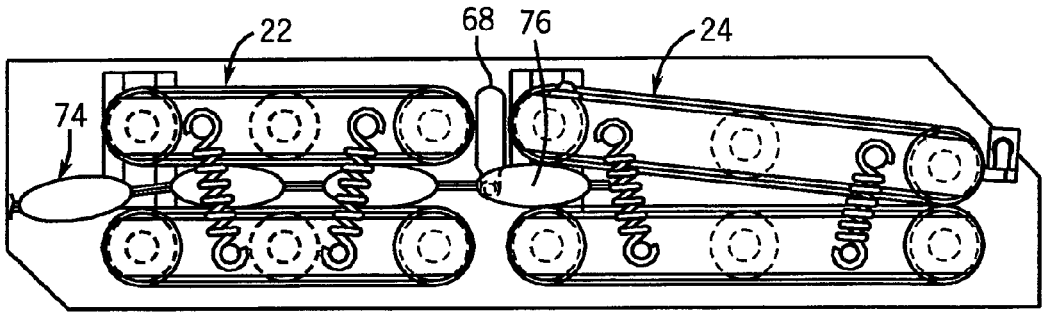
Figure 15:
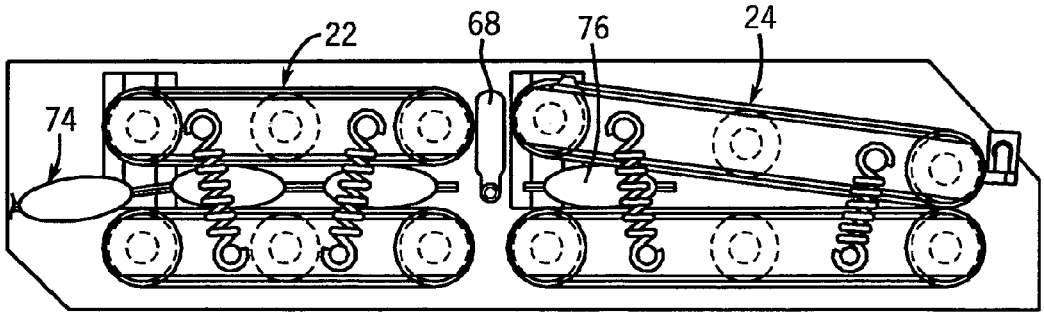
Figure 16:
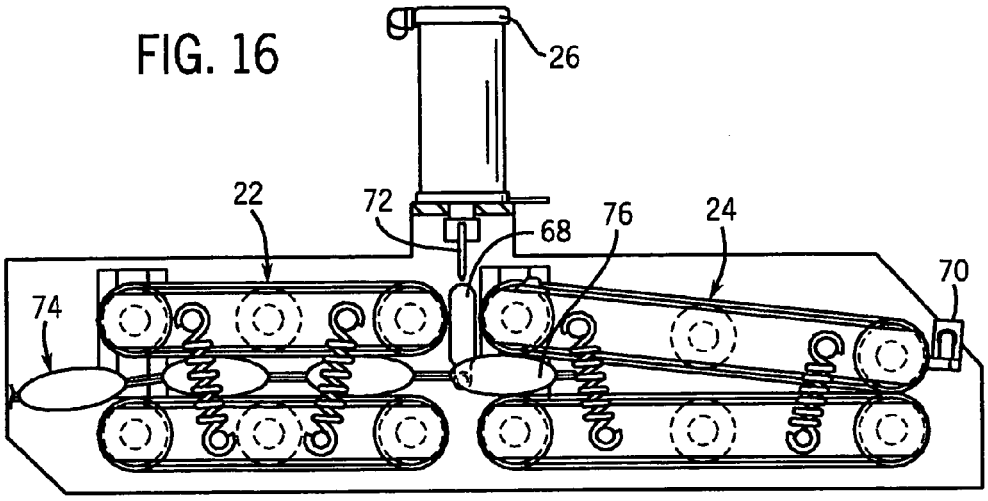
Figure 17:
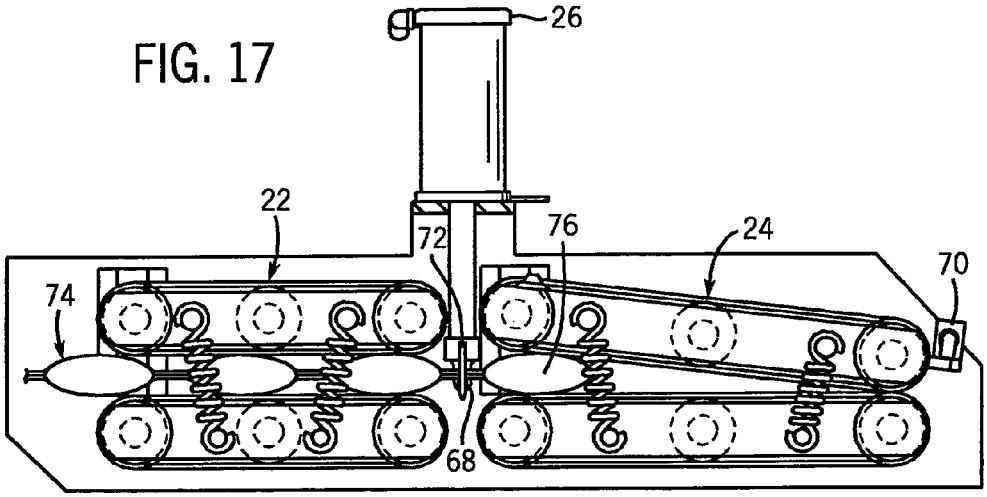

In another embodiment shown in FIGS. 13–15 and 16–17, the motor driving the delivery assembly 24 is continually running. In this embodiment where the delivery assembly 24 has at least one delivery belt 52 or 56 that is continuously moving. In the embodiment shown in FIG. 13 where the three-dimensional coupons are being placed into containers moving along a conveyor or other product handling device (See FIG. 1A), prior to any container 90 coming down in the line, a continuous web 74 is fed into the infeed assembly 22. A coupon 76 is not staged in the delivery assembly 24. The delivery drive motor 59 continuously drives delivery assembly 24. In one embodiment, at least one of the lower delivery belt 56 and the upper delivery belt 52 is continuously moving. When a container 90 comes down the line, the activation input 66 (in this case a container sensor that identifies the container) sends a signal to the controller 28. The infeed drive motor 42 attached to the infeed assembly 22 is then activated by the controller 28. The infeed drive motor 42 operates the infeed assembly 22, thereby feeding the leading edge of the continuous web 74 from the infeed assembly 22 to the delivery assembly 24 (FIG. 14). In one embodiment, the continuous web 74 is fed from the infeed assembly 22 into the delivery assembly 24 at predetermined linear speed. In another embodiment where the container 90 is traveling on a conveyor, the continuous web 74 is fed from the infeed assembly 22 into the delivery assembly 24 at the same linear speed as the conveyor.

Figure 18:
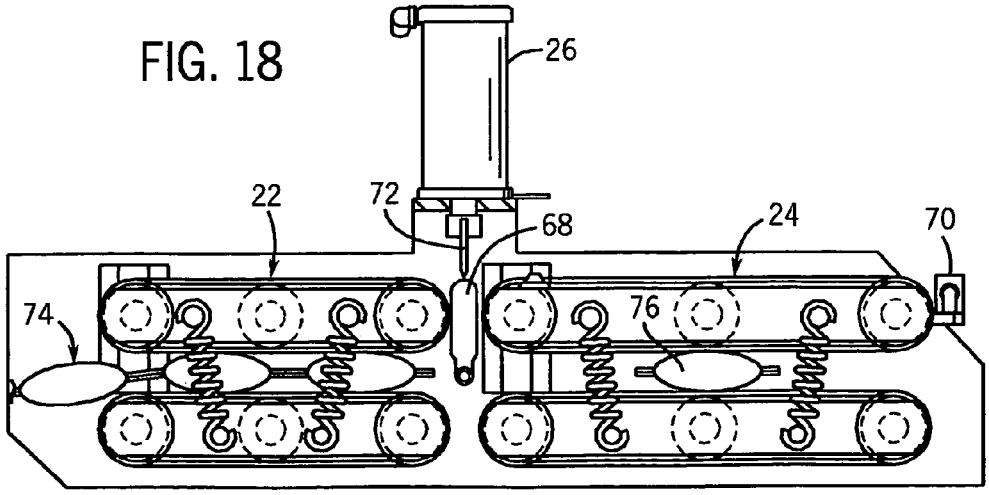

Regardless of the embodiment, feeding the continuous web from the infeed assembly 22 to the delivery assembly 24 causes the continuous web 74 to pass the coupon staging sensor 68. The coupon staging sensor 68 triggers the controller 28 to retrieve a programmed length/distance from memory. The controller 28 then activates the infeed drive motor 42 and operates the infeed assembly 22 to advance the continuous web 74 the programmed length/distance. After the infeed assembly 22 has advanced the continuous web 74, the infeed drive motor 42 stops and restarts the infeed assembly 42 in the opposite direction. The infeed assembly 42 moves the continuous web 74 in the direction toward the delivery assembly. The continuous web 74 is moved the programmed length/distance in this direction. In one embodiment shown in FIG. 16–18, a ram 26 fires causing the ram end 72 to help break (or cut in a knifed embodiment) the coupons apart. Advancement and retraction of the continuous web 74 combined with contact of the continuous web 74 with a continuously running delivery assembly 24 functions to separate a single coupon from the leading edge of the continuous web 74. Further, this combination functions to advance the separated coupon through the continuously operating delivery assembly 24. The process is repeated each time a container 90 passes the container sensor.

As illustrated by the foregoing description and shown in the Figures, the present invention is more suitable as a coupon inserter for use with three-dimensional coupons than existing systems. Although the invention has been herein shown and described in what is conceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and therefore, the invention is to be taken as including all reasonable equivalents to the subject matter of the appended claims.

We claim:

1. An apparatus for delivering coupons to a dispensing location, the coupons being provided as a continuous web of successive coupons with a forwardmost coupon having a trailing edge connected by a web portion to a leading edge of a following coupon, each successive coupon being similarly connected in the continuous web, said apparatus comprising:

an infeed assembly having an upper infeed belt and a lower infeed belt, movement of at least one of the infeed belts being driven by an infeed motor, wherein the upper infeed belt and the lower infeed belt are functionally connected to one another by a biased linkage so as to allow the infeed assembly to accommodate three-dimensional coupons;

a delivery assembly having an upper delivery belt and a lower delivery belt, movement of at least one of the delivery belts being driven by a delivery motor, wherein the upper delivery belt and the lower delivery belt are functionally connected to one another by a biased linkage so as to allow the infeed assembly to accommodate three-dimensional coupons; and, a controller in communication with an activation input, a coupon staging sensor, and a coupon delivery sensor connected thereto, the coupon staging sensor positioned within the apparatus such that it is capable of sensing coupons between the infeed assembly and the delivery assembly, the coupon delivery sensor positioned within the apparatus such that it is capable of sensing coupons as they are dispensed from the apparatus, the controller connected to the infeed drive motor and the delivery motor.

2. The apparatus of claim 1 further comprising a ram attached to the apparatus and positioned between the infeed assembly and the delivery assembly such that a ram can be selectively extended between the infeed belts of the infeed assembly and the delivery belts of the delivery assembly.

3. The apparatus of claim 1 wherein the entire upper infeed belt is moveable relative to a path of travel of the continuous web such that interaction of the web with the upper infeed belt forces the upper infeed belt to move with respect to the path of travel of the path of travel of the web.

4. The apparatus of claim 1 wherein the entire upper delivery belt is moveable relative to a path of travel of the continuous web such that interaction of the web with the upper infeed belt forces the upper delivery belt to move with respect to the path of travel of the path of travel of the web.

5. The apparatus of claim 1 wherein the entire lower infeed belt is moveable relative to a path of travel of the continuous web such that interaction of the web with the lower infeed belt forces the upper lower belt to move with respect to the path of travel of the path of travel of the web.

6. The apparatus of claim 1 wherein the entire lower delivery belt is moveable relative to a path of travel of the continuous web such that interaction of the web with the lower infeed belt forces the lower delivery belt to move with respect to the path of travel of the path of travel of the web.

7. The apparatus of claim 1 where the upper infeed belt is driven by the infeed drive motor.

8. The apparatus of claim 1 where the lower infeed belt is driven by the infeed drive motor.

9. The apparatus of claim 1 where both the upper and the lower infeed belts are driven by the infeed drive motor.

10. The apparatus of claim 1 where the upper delivery belt is driven by the delivery drive motor.

11. The apparatus of claim 1 where the lower delivery belt is driven by the delivery drive motor.

12. The apparatus of claim 1 where both the upper and the lower delivery belts are driven by the delivery drive motor.

13. An apparatus for delivering coupons to a dispensing location, the coupons being provided as a continuous web of successive coupons with a forwardmost coupon having a trailing edge connected by a web portion to a leading edge of a following coupon, each successive coupon being similarly connected in the continuous web, said apparatus comprising:

an infeed assembly having:

an upper infeed belt and a lower infeed belt, an infeed drive motor driving at least one of the infeed belts, at least one biased linkage functionally connecting the upper infeed belt to the lower infeed belt so as to allow at least one of the infeed belts to move relative to the path of travel of the continuous web so that the infeed assembly can accommodate three-dimensional coupons, and, a guide track in which the at least one moveable infeed belt travels; and, a delivery assembly having:

an upper delivery belt and a lower delivery belt, a delivery drive motor driving at least one of the delivery belts, at least one biased linkage functionally connecting the upper delivery belt to the lower delivery belt so as to allow at least one of the delivery belts to move relative to the path of travel of the continuous web so that the delivery assembly can accommodate three-dimensional coupons, and, a guide track in which the at least one moveable delivery belt travels.

14. The apparatus of claim 13 further comprising a controller in communication with an activation input, a coupon staging sensor, and a coupon delivery sensor connected thereto, the coupon staging sensor positioned within the apparatus such that it is capable of sensing coupons between the infeed assembly and the delivery assembly, the coupon delivery sensor positioned within the apparatus such that it is capable of sensing coupons as they are dispensed from the apparatus, the controller connected to the infeed drive motor and the delivery motor.

15. The apparatus of claim 13 further comprising a ram attached to the apparatus and positioned between the infeed assembly and the delivery assembly such that a ram can be selectively extended between the infeed belts of the infeed assembly and the delivery belts of the delivery assembly.

16. The apparatus of claim 13 wherein the entire upper infeed belt is moveable relative to a path of travel of the continuous web such that interaction of the web with the upper infeed belt forces the upper infeed belt to move with respect to the path of travel of the path of travel of the web.

17. The apparatus of claim 13 wherein the entire upper delivery belt is moveable relative to a path of travel of the continuous web such that interaction of the web with the upper infeed belt forces the upper delivery belt to move with respect to the path of travel of the path of travel of the web.

18. The apparatus of claim 13 wherein the entire lower infeed belt is moveable relative to a path of travel of the continuous web such that interaction of the web with the lower infeed belt forces the upper lower belt to move with respect to the path of travel of the path of travel of the web.

19. The apparatus of claim 13 wherein the entire lower delivery belt is moveable relative to a path of travel of the continuous web such that interaction of the web with the lower infeed belt forces the lower delivery belt to move with respect to the path of travel of the path of travel of the web.

20. The apparatus of claim 13 where the upper infeed belt is driven by the infeed drive motor.

21. The apparatus of claim 13 where the lower infeed belt is driven by the infeed drive motor.

22. The apparatus of claim 13 where both the upper and the lower infeed belts are driven by the infeed drive motor.

23. The apparatus of claim 13 where the upper delivery belt is driven by the delivery drive motor.

24. The apparatus of claim 13 where the lower delivery belt is driven by the delivery drive motor.

25. The apparatus of claim 13 where both the upper and the lower delivery belts are driven by the delivery drive motor.

* * * * *